US008303775B2

(12) United States Patent
Yazaki et al.

(10) Patent No.: US 8,303,775 B2
(45) Date of Patent: Nov. 6, 2012

(54) PAPERMAKING PRESS FELT AND PAPERMAKING METHOD

(75) Inventors: Takao Yazaki, Tokyo (JP); Takashi Ouchi, Tokyo (JP); Hiroyuki Oda, Tokyo (JP); Hirofumi Murakami, Tokyo (JP); Yuya Takamori, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 12/823,690

(22) Filed: Jun. 25, 2010

(65) Prior Publication Data

US 2011/0108224 A1 May 12, 2011
US 2011/0253328 A2 Oct. 20, 2011

(30) Foreign Application Priority Data

Nov. 10, 2009 (JP) ..... 2009-257389

(51) Int. Cl.
*D21F 7/08* (2006.01)

(52) U.S. Cl. ..... 162/358.2; 162/900

(58) Field of Classification Search .... 162/358.1–358.2, 162/900
See application file for complete search history.

(56) References Cited

U.S. PATENT DOCUMENTS 4,414,263 A * 11/1983 Miller et al. ..... 442/270
6,001,455 A * 12/1999 Nishio et al. ..... 428/156
7,481,906 B2 * 1/2009 Ouchi et al. ..... 162/358.2
7,481,907 B2 * 1/2009 Ouchi et al. ..... 162/358.2
7,517,434 B2 * 4/2009 Ouchi et al. ..... 162/358.2
7,909,965 B2 * 3/2011 Yazaki et al. ..... 162/358.4
7,943,013 B2 * 5/2011 Yazaki et al. ..... 162/358.2
7,947,154 B2 * 5/2011 Yazaki et al. ..... 162/358.4
7,955,475 B2 * 6/2011 Yazaki et al. ..... 162/358.4
2005/0124248 A1 6/2005 Hyvonen
2006/0113053 A1 * 6/2006 Ouchi et al. ..... 162/358.2
2006/0130992 A1 * 6/2006 Ouchi et al. ..... 162/358.1
2006/0175032 A1 * 8/2006 Ouchi et al. ..... 162/358.2

(Continued)

FOREIGN PATENT DOCUMENTS

JP 2005-524002 8/2005

(Continued)

OTHER PUBLICATIONS

Decision to Grant a Patent in JP Patent Application No. 2009-257389, Drafting Date Oct. 8, 2010, Dispatch No. 738173, Dispatch Date Nov. 2, 2010 (with English translation).
U.S. Appl. No. 12/884,552, filed Sep. 17, 2010, Ouichi, et al.

*Primary Examiner* — Jose A Fortuna
(74) *Attorney, Agent, or Firm* — Oblon, Spivak, McClelland, Maier & Neustadt, L.L.P.

(57) ABSTRACT

A papermaking felt which can be easily engaged in a papermaking machine, wherein the work time for engaging the felt is short, the initial warming-up period until reaching the highest papermaking speed is short, and the felt life is long, which is achieved by integrating and attaching by dispersion in the batt layer of the felt a polymeric elastomer having high deformability when pressure is applied and good recoverability after pressure is applied, which polymeric elastomer is attached in an amount of 0.5 to 20 wt. % of the felt, and which polymeric elastomer has a property that when in the form of a film and when measured at a room temperature of 20° C. and a relative humidity of 65%, the 100% modulus value of the film is 1 to 100 kg/cm$^2$, the residual strain after 100% elongation is 30% or less.

7 Claims, 3 Drawing Sheets

U.S. PATENT DOCUMENTS

| | | | | |
|---|---|---|---|---|
| 2009/0163104 | A1 | 6/2009 | Westerkamp et al. | |
| 2010/0018663 | A1 | 1/2010 | Oouchi | |
| 2010/0147480 | A1* | 6/2010 | Yazaki et al. | 162/358.4 |
| 2010/0252218 | A1* | 10/2010 | Ohuchi | 162/289 |
| 2010/0314067 | A1* | 12/2010 | Yazaki et al. | 162/358.2 |
| 2011/0011551 | A1* | 1/2011 | Ouchi et al. | 162/289 |
| 2011/0017419 | A1* | 1/2011 | Yazaki et al. | 162/289 |
| 2011/0108224 | A1* | 5/2011 | Yazaki et al. | 162/100 |
| 2011/0127000 | A1* | 6/2011 | Yazaki et al. | 162/289 |

FOREIGN PATENT DOCUMENTS

| | | | |
|---|---|---|---|
| JP | 2006-9207 | | 1/2006 |
| JP | 2008-150738 | | 7/2008 |
| JP | 2009-127135 | | 6/2009 |
| JP | 2010242274 | A * | 10/2010 |
| JP | 4625135 | | 11/2010 |
| JP | 2011026711 | A * | 2/2011 |
| WO | 2008/004618 | | 2/2008 |

* cited by examiner

PAPERMAKING PRESS FELT AND PAPERMAKING METHOD

FIELD OF THE INVENTION

The present invention relates to a papermaking press felt (also called "press fabric") used in a papermaking machine. In greater detail, the present invention relates to a papermaking press felt (hereinafter also simply called "felt") having good water squeezing capability of the wet paper web wherein, when a new papermaking press felt is installed in a papermaking machine, the period of time is shortened which is required for gradually increasing the papermaking speed from immediately after the start of the papermaking operation until the highest papermaking speed is reached (this period is called the initial warming-up period), and wherein the operation of the papermaking machine is stabilized.

DESCRIPTION OF RELATED ART

Conventionally, papermaking machines in the papermaking process are generally equipped with a wire part, a press part and a dryer part to dewater wet paper webs. These parts are provided in the direction in which the wet paper web is transferred in the order of: wire part, press part and dryer part. The wet paper web is squeezed and dewatered and, at the same time, transferred while being passed from one papermaking equipment to the next provided in the wire part and press part, respectively, to be finally dried in the dryer part.

In these parts, papermaking equipment is used which corresponds to the functions of dewatering the wet paper web (wire part), squeezing water from the wet paper web (press part) and drying the wet paper web (dryer part). Moreover, the press part is generally equipped with one or more press devices arranged in series in the direction in which the wet paper web is transported.

Each press device comprises an endless felt (closed type) or an open-ended felt that has been formed into an endless felt by connecting it in the papermaking machine. Each press device also comprises a pair of rolls, which face each other (i.e. a roll press), or a roll and a shoe, which face each other (i.e. a shoe press); the wet paper web is placed on the felt, and, while it is moving together with the felt in the wet paper web conveyance direction, moisture is squeezed from the wet paper web by pressing the wet paper web together with the felt in the roll press or in the shoe press; the moisture pressed from the wet paper web is continuously absorbed by the felt or passes through the felt to be drained to the outside of the felt.

Hereinafter, one example of the press part of a papermaking machine will be described in detail with reference to FIG. 1. The papermaking parts are arranged in the wet paper web conveyance direction in the order of wire part, which is the fore-part in the papermaking process, press part positioned thereafter, and dryer part positioned after the press part. This press part is of a typical transfer twinbar type papermaking machine and comprises 4 press devices; the press devices: No. 1 press device (1P) formed by a top roll 1*a* and a bottom roll 1*b*, No. 2 press device (2P) formed by a No. 2 roll and a center roll (CR), No. 3 press device (3P) formed by a No. 3 roll and the center roll (CR), and No. 4 press device (4P) formed by a top roll 4*a* and a bottom roll 4*b*, respectively, are provided next to each other in series in the wet paper web conveyance direction. Moreover, there are also papermaking machines in which, in the press devices, either the top rolls (1*a* or 4*a*) or the bottom rolls (1*b* or 4*b*) are configured as a shoe press device, or in which roll 3 is configured as a shoe press device.

The above-mentioned transfer twinbar type papermaking machines use a plurality of papermaking felts (4 felts in FIG. 1). Normally, the felts used are a pickup felt (PU felt) for receiving the wet paper web from the wire part, a pickup felt used on the top roll side of the No. 1 press device (1P), a 1P bottom felt used on the bottom roll side, a 3P felt used in the No. 3 press device (3P), and a 4P felt used in the No. 4 press device (4P). The pickup felt serves for a felt used in the No. 2 press device (2P).

The above-mentioned felts are made from a reinforcing fiber base material 5 and batt layers 6, 7 as shown in FIG. 2 or 3; a batt layer is provided on both the wet paper web carrying side and the press roll side of the reinforcing fiber base material, or only on the wet paper web carrying side. The batt layers 6, 7 are made by intertwiningly integrating short fibers (staple fibers), from which the batt is made, with the reinforcing fiber base material by needle punching. These felts have the fundamental functions of squeezing water from the wet paper web (water squeezing capability), of increasing the smoothness of the wet paper web and of conveying the wet paper web.

Of the above-mentioned felt function, particularly the function of squeezing water from the wet paper web is considered to be important. The wet paper web is pressure squeezed together with the felt by passing the pressure position of the roll press or the shoe press; and after the moisture of the wet paper web has been transferred to the felt, it is drained outside the felt by the suction force of a suction box or the pressure of a squeeze press; therefore, the water permeability for assuring a suitable void volume in the felt and the ability to maintain compressibility and recoverability are considered to be important properties.

The above-mentioned suitable void volume is the void volume of a felt when the highest papermaking speed has been reached after it has been gradually increased. In other words, from the viewpoint of productivity, it is important that the operating speed of a papermaking machine rapidly reaches the highest papermaking speed as soon as possible after starting to make paper with a new felt. The period until the highest papermaking speed is reached (the initial warming-up period) differs according to the operating conditions of the papermaking machine; however, in general one to two days, at most five days, are required. It is particularly important to shorten the initial warming-up period of the above-mentioned felts with wet paper conveyance methods such as the no-draw straight-through method, of which the Tandem-Nipco Flex Press and OptiPress papermaking machines are representative examples, because high operating speeds are used.

Strategies to make the felt thinner and increase the felt density by applying pressure after the felt has been made have been used to shorten the initial warming-up period of these felts. There are also cases in which the felt is brought into contact with a roll that has been heated by a heating medium in order to increase the pressing effect of the felt. Due to the operating and the effect of a high density felt it is possible to facilitate the transfer of the pressing force received by the felt in the press part to the wet paper web by reducing the void volume in the felt.

In JP, T, 2005-524002 (Patent document 1), a felt and a production method are disclosed in which the void volume of the felt surface is reduced and the density is increased by polishing the felt surface after the felt front side (wet paper web carrying side) has been treated with a polymer substance. A papermaking felt of this structure is compacted as a new felt from the beginning (with an increased density); therefore, when the felt is used in a papermaking machine, the initial warming-up period is shortened.

Nevertheless, even though a papermaking felt using a polymer of the polymer substances mentioned in Patent document 1, which are polyurethane, polycarbonate urethane, polyacrylate, acryl resin, epoxy resin, phenol resin or mixed polymers thereof, can be compacted due to the adhesive force and the coagulating force of the polymers, stiffness is given to the felt as a whole. When the stiffness of a felt increases, the compressibility and recoverability under the press of a papermaking machine is suppressed; therefore, there is a loss of the wet paper web water squeezing performance; moreover, when the papermaking felt is placed in a papermaking machine, due to the felt stiffness, it is difficult to place the felt which has to be manually inserted in the narrow spaces between the rolls inside the papermaking machine.

Furthermore, US, A1, No. 2009/0163104 (Patent document 2) discloses a press fabric (felt), wherein the felt surface is coated with a polymer dispersion liquid which, by drying, bridges the batt fiber spaces by covering them with a polymer film (membrane); moreover, by covering the surroundings of the batt fibers (the polymer layer thickness is 0.05 mm to 1.5 mm), the polymer membrane adjusts the void volume and the density of the felt surface layer without separating from the batt fibers. Examples of polymers include polyurethane elastomers, polyether-polyamide elastomers, engineering polyamides (polyamide 11, polyamide 12, polyamide 6.12, or the like). The blending amount of the polymers in relation to the felt weight is not disclosed by specific figures.

This felt is characterized in that the air-permeability is suitably adjusted and in that it can be subjected to washing by a high pressure water jet. Nevertheless, even though the initial warming-up period of the felt can be shortened, there is the disadvantage that, since the void volume is reduced and the overall thickness of the felt is thinner, the felt is flattened by the press pressure repeatedly received during use and rapidly arrives at the limit of the thickness that can be used, and the period during which the wet paper web can be sufficiently squeezed (felt life) is shortened.

CITATION LIST

Patent Literature

Patent document 1: JP, T, No. 2005-524002
Patent document 2: US, A1, No. 2009/0163104

SUMMARY OF THE INVENTION

Technical Problem

Compared to conventional felts, wherein the void volume for transferring mechanical pressure and hydraulic pressure to the squeezed wet paper web is poor, the object of the present invention is to provide a felt, wherein a suitable void volume for the initial warming-up period can be ensured from the start of use, and wherein the initial warming-up period of the felt can be shortened to four days or less. Moreover, the present invention also provides a felt, wherein, if the thickness deformation resistance of the felt is reduced, pressure density tends to increase when pressure is applied by the press rolls or the like, recoverability after pressing is high, accumulation of dirt and excessive flattening are less likely to occur, and water permeability and compressibility can be maintained for a long time. To provide such a felt is also an object of the present invention.

Specifically, the present invention provides a papermaking press felt, wherein, by including a polymeric elastomer having suitable flexibility and good compressibility and recoverability, a suitable void volume can be assured in the felt, water permeability and compressibility can be maintained for a long time, the initial warming-up period of the papermaking press felt is shorter than that of a conventional felt, the felt life is long, and water squeezing capability is good.

Solution to Problem

The invention according to claim 1 provides a papermaking press felt comprising a reinforcing fiber base material and batt layers provided on both the wet paper web carrying side and the press roll side of said reinforcing fiber base material or a batt layer provided only on the wet paper web carrying side of said reinforcing fiber base material; wherein a polymeric elastomer is dispersedly attached to the batt layer inside the felt on the wet paper web carrying side of the felt; wherein, when said polymeric elastomer is in the form of a film and when measured at a room temperature of 20° C. and a relative humidity of 65%, the 100% modulus value of the film is 1 to 100 kg/cm$^2$, the residual strain after 100% elongation is 30% or less, and the attached amount of polymeric elastomers is 0.5 to 20 wt. % of the papermaking press felt weight.

The invention according to claim 2 provides a papermaking felt according to claim 1; wherein the polymeric elastomer comprises one or more members selected from the group consisting of natural rubber, isoprene rubber, 1,4-butadiene rubber, 1,2-butadiene rubber, styrene-butadiene copolymer rubber, chloroprene rubber, nitrile rubber, butyl rubber, ethylene-propylene copolymer rubber, ethylene-propylene-butadiene copolymer rubber, ethylene-propylene-ethylidene norbornene copolymer rubber, chlorosulfonated polyethylene elastomer, acrylic rubber, epichlorohydrine rubber, polysulfide rubber, silicone rubber, fluoro rubber, polyurethane elastomer, polyolefin elastomer in which the above-mentioned rubbers or ethylene-vinyl acetate copolymers have been blended with polyethylene, polyamide elastomer, polyester elastomer, polystyrene elastomers selected from the group consisting of styrene-butadiene-styrene-copolymer elastomer, styrene-ethylene-butylene-styrene copolymer elastomer, acrylonitrile-butadiene-styrene copolymer elastomer or hydrogenated products thereof, and plasticized vinyl chloride resin.

Advantageous Effects of Invention

With the papermaking press felt according to the present invention, a suitable void volume for the initial warming-up period can be ensured from the start of use, and the initial warming-up period can be shortened. Moreover, the present invention also provides a felt, wherein, if the thickness deformation resistance of the felt is reduced, pressure density tends to increase when pressure is applied by the press rolls or the like, recoverability after pressing is high, accumulation of dirt and excessive flattening are less likely to occur, and water permeability and compressibility can be maintained for a long time. By means of such a felt, it is possible to obtain a papermaking press felt having a good balance of the fundamental felt functions such as a maintenance of the water squeezing capability of the felt, or the like.

DETAILED DESCRIPTION OF THE INVENTION

Hereinafter, the present invention will be described in detail with reference to the drawings.

Figure 1:
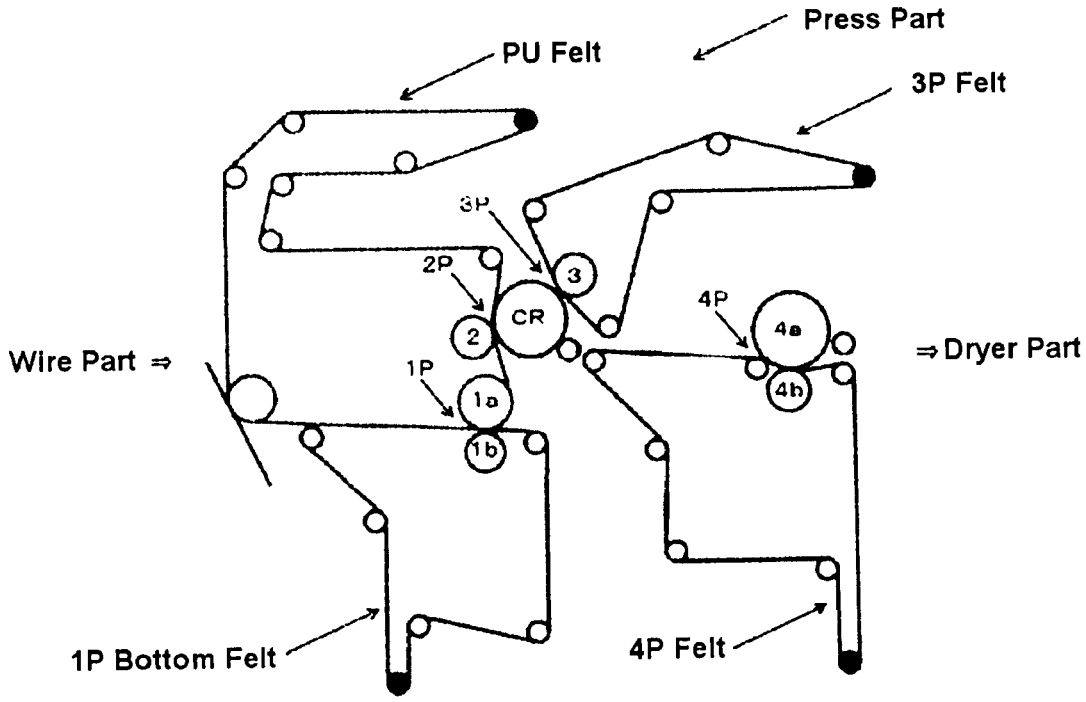
FIG. 1 is a schematic diagram of the press part of a papermaking machine.
Figure 2:
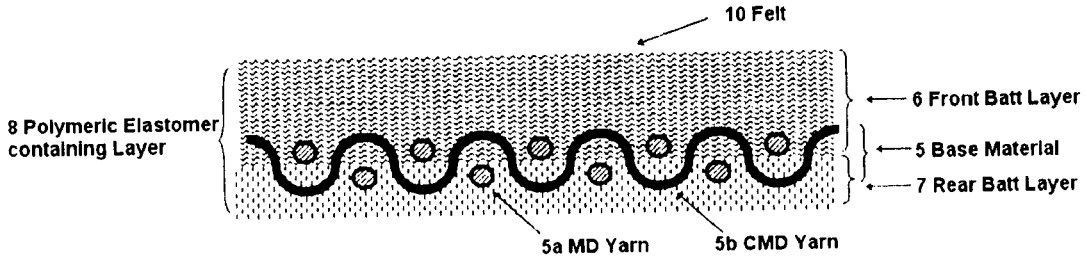
FIG. 2 is a view showing a state in which the polymeric elastomer present stays in the front-side batt layer in the papermaking press felt.
Figure 3:
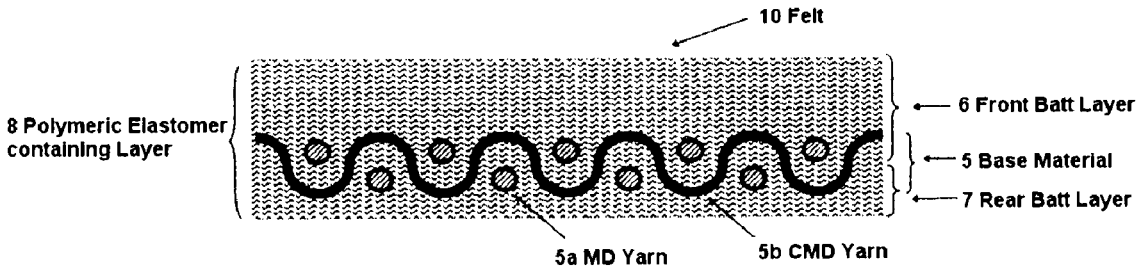
FIG. 3 is a view showing a state in which the polymeric elastomer present extends from the front-side batt layer to the rear-side batt layer in the papermaking press felt.

The present invention is a press felt for use in the press part shown in FIG. 1. The press felts according to the present invention exemplified in FIGS. 2 and 3 comprise a reinforcing fiber base material 5, a front batt layer 6 provided on the wet paper carrying side (front side) of said base material, and a rear batt layer 7 provided on the press roll side (rear side) of said base material; wherein a polymeric elastomer stays in the front batt layer 6, or the polymeric elastomer extends from the front batt layer to the rear batt layer 7, as respectively shown in FIGS. 2 and 3.

The reinforcing fiber base material 5 generally is a woven fabric woven from a CMD (Cross Machine Direction) yarn and a MD (Machine Direction) yarn by a loom or the like; however, a lattice material obtained by overlapping rows of CMD yarns and MD yarns without weaving may also be used.

Examples of materials for the reinforcing fiber base material, which is made from CMD and MD yarns, and for the batt include polyesters (polyethylene terephthalate, polybutylene terephthalate, or the like), engineering polyamides (polyamide 11, polyamide 12, polyamide 6.12, or the like), aromatic polyamides (aramide), polyvinylidene difluoride, polypropylene, polyether-polyester ketone, polytetrafluoroethylene, polyethylene, cotton, wool, metal, or the like.

Examples of materials for the polymeric elastomer include one or more members selected from the group consisting of natural rubber, isoprene rubber, 1,4-butadiene rubber, 1,2-butadiene rubber, styrene-butadiene copolymer rubber, chloroprene rubber, nitrile rubber, butyl rubber, ethylene-propylene copolymer rubber, ethylene-propylene-butadiene copolymer rubber, ethylene-propylene-ethylidene norbornene copolymer rubber, chlorosulfonated polyethylene elastomer, acrylic rubber, epichlorohydrine rubber, polysulfide rubber, silicone rubber, fluoro rubber, polyurethane elastomer, polyolefin elastomer in which the above-mentioned rubbers or ethylene-vinyl acetate copolymers have been blended with polyethylene, polyamide elastomer, polyester elastomer, polystyrene elastomers selected from the group consisting of styrene-butadiene-styrene-copolymer elastomer, styrene-ethylene-butylene-styrene copolymer elastomer, acrylonitrile-butadiene-styrene copolymer elastomer or hydrogenated products thereof, and plasticized vinyl chloride resin.

Figure 4:
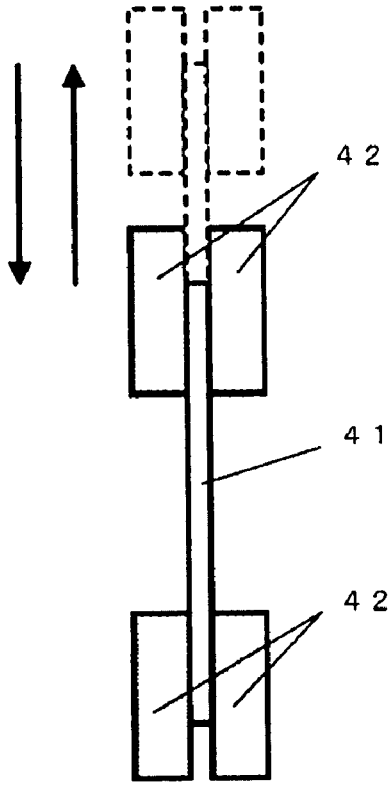
FIG. 4 is a schematic diagram of a tensile test.

FIG. 4 shows the measuring part of a test apparatus used for measuring the 100% modulus value and the residual strain after 100% elongation of a polymeric elastomer film. In the 100% modulus value measurement, JIS K6251-2004 was referred and in the measurement of the residual strain after 100% elongation, JIS K6262-1997 was referred, and these tests were performed under the conditions described hereinafter.

In both tests, a polymeric elastomer specimen 41 was a film of 10 mm width, 120 mm length (including 40 mm for the grip on each side), 40 mm grip distance, and 0.5 mm thickness. The tests were performed at a room temperature of 20° C. and a relative humidity of 65%.

The specimen 41 was set in grips 42, stretched to an elongation percentage of 110% at a stretching speed of 200 mm/min, and the stress (kg/cm$^2$) at an elongation percentage of 100% was taken as the 100% modulus value.

Further, the specimen was stretched to an elongation percentage of 100%, the elongation was reversed at the same speed the moment after reaching the elongation percentage of 100%, and the percentage of elongation when the stress reached 0 kg/cm$^2$ was taken as the residual strain after an elongation of 100%.

The polymeric elastomer may be foamed or partially cross-linked. It may further comprise (an) inorganic filler(s) and (a) thermal stabilizer(s). Examples of foaming agents include ammonium carbonate, sodium bicarbonate, ammonium bicarbonate, sodium hydrogencarbonate, or the like and examples of inorganic fillers include titanium oxide, kaolin, clay, talc, diatomaceous earth, calcium carbonate, calcium silicate, magnesium silicate, fused silica, mica, or the like.

The polymeric elastomer is attached to the short fibers (staple fibers) constituting the batt by dispersing fragments with 5 μm to 2 mm thickness. It can also be envisioned to use the short fibers (staple fibers) as the center which becomes a core around which the polymeric elastomer is coated in the shape of a sheath with a thickness of 1 to 40 μm. When the polymeric elastomer is attached to the batt fibers in the shape of fragments and/or in the shape of a sheath formed around a core, the felt has good compressibility, recoverability and water squeezing capability; there is moreover the added advantage that, during the period of use of the felt, these characteristics can be maintained for a long time.

In view of felt compressibility, recoverability and water squeezing capability, the 100% modulus of the polymeric elastomer film is 1 to 100 kg/cm$^2$, and preferably 70 kg/cm$^2$ or less. Also in view of felt compressibility, recoverability and water squeezing capability, the residual strain after 100% elongation is 30% or less, and preferably 20% or less.

The amount of attached polymeric elastomer is 0.5 to 20 wt. % of the papermaking press felt weight. When the amount is less than 0.5 wt. % of the felt weight, it is not possible to maintain water permeability and compressibility of the felt for a long time, which results in a deterioration of the felt durability. If, on the other hand, the amount is more than 20 wt. % of the felt weight, felt stiffness is too great and the thickness deformation resistance cannot be reduced, the pressure density does not easily increase when pressure is applied by the press rolls or the like, and the recoverability after pressing can decline.

The location in which the polymeric elastomer is included in the papermaking felt is not particularly limited; however, preferably it is included in the region comprising the reinforcing fiber base material and the wet paper web carrying side batt layer (front batt layer). Specifically, it can be included in the wet paper web carrying side batt layer only, in the region extending from the wet paper web carrying side batt layer to the press roll side batt layer (rear batt layer), in the region from the wet paper web carrying side batt layer to the reinforcing fiber base material, or in the region from the press roll side batt layer to the reinforcing fiber base material.

The polymeric elastomer can be attached(bonded) to the short fibers (staple fibers) constituting the batt by coating/impregnating on the felt surface by means of coating, spraying, blade coating, or the like and, thereafter, drying a solvent dispersion liquid of the polymeric elastomer.

The papermaking press felt according to the present invention should include a void volume (air permeability: 2 to 50 cc/cm$^2$ sec., 125 Pa) that enables the felt to transmit mechanical and hydraulic pressure to the squeezed wet paper web. In other words, the felt should maintain a fixed void volume from the initial warming-up period to the highest papermaking speed region, in which the operating speed has stabilized, and until the end of service is reached.

The degree of felt hardness (stiffness) of the papermaking press felt according to the present invention is preferably such that the felt is easily deformed when pressure is applied by the press roll, or the like, and the felt density is increased to its highest limit. To achieve this, the polymeric elastomer included in the felt has an elasticity expressed by the above-mentioned 100% modulus and the residual strain after 100% elongation.

Batt fiber (nylon 6 staple fiber of 17 dtex)

wet paper web carrying side (front batt layer) of the reinforcing base material:

basis weight 500 g/m$^2$ press roll side (rear batt layer) of the reinforcing fiber base material:

basis weight 250 g/m$^2$

After making the felt by stacking and intertwiningly integrating the rear-side batt fibers and the front-side batt fibers with the reinforcing fiber base material by needling, the polymeric elastomer was spray coated from the front side of the felt, dried at 105° C., and, thereafter, cured at 140° C.

The polymeric elastomer resins shown in Table 1 were applied under the conditions given in the same Table.

TABLE 1

| | | | | Polymeric elastomer film characteristics | | Felt coating | |
|---|---|---|---|---|---|---|---|
| | Polymeric elastomer | Foaming agent | Filler | 100% modulus (kg/cm$^2$) | Strain (%) after 100% elong. | Attached amount (wt. %) | Attached shape |
| Example 1 | Polyurethane elastomer (SUPERFLEX[1)]) | — | — | 2 | 3 | 10 | sheath |
| Example 2 | Polyurethane elastomer (Impranil[2)]) | — | — | 70 | 19 | 5 | sheath |
| Example 3 | Styrene-butadiene rubber (Nalstar[3)]) | — | — | 8 | 5 | 20 | sheath & fragments |
| Example 4 | Silicone rubber (KE[4)]) | — | — | 24 | 15 | 5 | sheath |
| Example 5 | Polyethylene elastomer (HYTEC[5)]) | — | — | 3 | 18 | 5 | fragments |
| Example 6 | Polyurethane elastomer (EVAFANOL[6)]) | — | — | 15 | 11 | 5 | sheath |
| Example 7 | Polyurethane elastomer (EVAFANOL[6)]) | Hydrocerol 10 wt. % | — | 10 | 8 | 5 | fragments |
| Example 8 | Polyurethane elastomer (EVAFANOL[6)]) | — | Kaolin 10 wt. % | 17 | 13 | 5 | sheath |
| Comparat. Example 1 | Without resin | — | — | — | — | — | — |
| Comparat. Example 2 | Polyurethane elastomer (ADEKA BONTIGHTER[7)]) | — | — | 120 | 38 | 5 | sheath |

[1)]Daiichi Kogyo Seiyaku Co., Ltd.
[2)]Bayer Japan Co., Ltd.
[3)]Nippon A & L Inc.
[4)]Shinetsu Chemical Co., Ltd.
[5)]Toho Chemical Industry Co., Ltd.
[6)]Nicca Chemical Co., Ltd.
[7)]ADEKA Corporation

EXAMPLES

Hereinafter, the present invention will be described with reference to the Examples and Comparative Examples. The present invention is, however, not limited to these Examples.

Examples 1 to 8 and Comparative Examples 1 and 2

Figure 5:
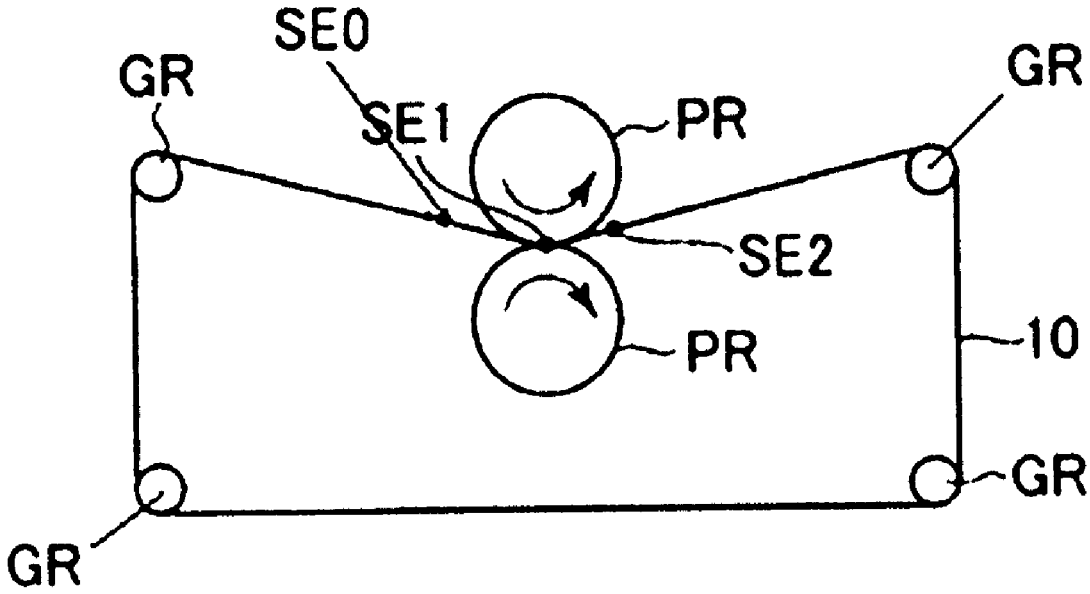
FIG. 5 is a schematic diagram of a press tester.

The basic configuration of the felts used in the Examples and Comparative Examples was as follows:

Reinforcing fiber base material (nylon monofilament twine, single weave): basis weight 750 g/m$^2$ The press tester shown in FIG. 5 was used to perform running tests with the felts produced in Examples 1 to 8 and Comparative Examples 1 and 2 (conditions: 1,000 m/min, 100 KN/m pressure, 100 hours); and the water squeezing capability and the elasticity maintaining properties of the felts were evaluated.

When the press tester shown in FIG. 5 is used, a sample of a felt 10 runs around guide rolls GR while being pressed (squeeze pressed) by a pair of press rolls PR, PR. In this press tester, the thickness of the felt 10 before pressing, during pressing and after pressing can be measured by thickness sensors SE0, SE1 and SE2, respectively. Moreover, a sample of the wet paper web can be taken at the entrance of the pair of press rolls PR, PR, the wet paper web can be recovered at the press exit, and the moisture thereof can be measured. The test was performed by adjusting the moisture of the felt by a shower which delivered the moisture.

The squeezing test of the wet paper web was performed with the following press tester conditions and formulae:

Squeezing test conditions: pressure = 100 KN/m, paper speed = 1,000 m/min

Moisture content of the wet paper web before pressing: 70%

Moisture content of the wet paper web before pressing =

(wet paper web weight before pressing − dried paper weight)/wet paper weight before pressing × 100

Moisture content of the wet paper web after pressing =

(wet paper web weight after pressing − dried paper weight)/wet paper weight after pressing × 100

The lower the moisture content of the wet paper web after pressing, the better is the water squeezing capability of the felt. In the papermaking sector it is understood that, even if the difference in moisture content of the wet paper web after squeezing is only 1%, there is a big impact on the amount of thermal energy required in the paper drying process after pressing.

The compression test of the felt was performed with the following press tester conditions and formulae:

In the press tester:

| | |
|---|---|
| thickness before pressing: | T0 |
| thickness during pressing: | T1 (100 KN/m) |
| thickness after pressing: | T2 |
| compression rate during pressing = | (T0 − T1)/T0 × 100 |
| thickness maintaining rate before and after pressing = | T2/T0 × 100 |

The results of these tests are shown in Table 2.

TABLE 2

| | Evaluation items Properties during running test | | | | | |
|---|---|---|---|---|---|---|
| | Water squeezing capability | | Ability to maintain elasticity | | | |
| | Moisture content (%) of the wet paper web after pressing | | Compression rate (%) during pressing | | Thickness maintaining rate (%) before and after pressing | |
| | after 10 min | after 100 h | after 10 min | after 100 h | after 10 min | after 100 h |
| Example 1 | 48 | 46 | 29.6 | 26.8 | 85.3 | 87.5 |
| Example 2 | 52 | 50 | 25.9 | 22.8 | 83.5 | 85.8 |
| Example 3 | 47 | 45 | 27.9 | 26.3 | 85.4 | 87.8 |
| Example 4 | 51 | 48 | 26.3 | 23.0 | 84.1 | 86.4 |
| Example 5 | 48 | 47 | 29.6 | 24.5 | 83.5 | 85.4 |
| Example 6 | 49 | 46 | 28.2 | 24.4 | 84.9 | 87.1 |
| Example 7 | 49 | 48 | 28.9 | 26.0 | 85.2 | 87.2 |
| Example 8 | 50 | 48 | 26.9 | 24.6 | 84.4 | 87.1 |
| Comparat. Example 1 | 56 | 53 | 29.7 | 22.1 | 81.5 | 84.3 |
| Comparat. Example 2 | 54 | 52 | 25.2 | 22.1 | 82.9 | 84.9 |

Table 2 shows that the smaller the value of the moisture content of the wet paper web after pressing, the better is the water squeezing capability, and the bigger the values of compression rate during pressing (corresponding to the compressibility of the felt) and the thickness maintaining rate before and after the pressing (corresponding to the recoverability of the felt after compression), the better is the ability to maintain elasticity.

Examples 1 to 8 show that the capability to squeeze water from a wet paper web as well as the felt compressibility and recoverability and the maintaining properties thereof are improved according to a kind of a polymeric elastomer included.

INDUSTRIAL APPLICABILITY

The papermaking felt obtained according to the present invention can improve the capability to squeeze water from a wet paper web throughout its period of use including the initial warming-up period until the highest papermaking speed is reached, at which stable production of a papermaking machine is possible; and, compared to felts like those in Comparative Example 2 in which a high modulus resin was used, a felt according to the present invention can be easily installed in a papermaking machine.

DESCRIPTION SIGN LIST

| | |
|---|---|
| 1P to 4P | No. 1 press device to No. 4 press device |
| 1a, 4a | Top rolls |
| 1b, 4b | Bottom rolls |
| CR | Center roll |
| 2, 3 | Rolls |
| 5 | Reinforcing fiber base material |
| 5a | MD yarn |
| 5b | CMD yarn |
| 6 | Front batt layer |
| 7 | Rear batt layer |
| 8 | Polymeric elastomer containing layer |
| 10 | Felt |

-continued

| | |
|---|---|
| 41 | Specimen |
| 42 | Grips |
| GR | Guide rolls |
| PR | Press rolls |
| SE0 | Thickness sensor |
| SE1 | Thickness sensor |
| SE2 | Thickness sensor |

The invention claimed is:

1. A papermaking press felt, comprising:

a reinforcing fiber base material; and batt layers provided on both a wet paper web carrying side and a press roll side of the reinforcing fiber base material, or a batt layer provided only on the wet paper web carrying side of the reinforcing fiber base material;

wherein:

a polymeric elastomer is dispersedly attached to a wet paper web carrying side surface of the wet paper web carrying side batt layer of the felt in the shape of fragments or in the shape of a sheath formed around fibers of the batt layer;

when the polymeric elastomer in a form of a film is measured at a room temperature of 20° C. and a relative humidity of 65%, a 100% modulus value of the film is 1 to 100 kg/cm$^2$, a residual strain after 100% elongation is 30% or less; and an attached amount of the polymeric elastomers is 0.5 to 20 wt. % of a total weight of the papermaking press felt.

2. The papermaking press felt according to claim 1, wherein the polymeric elastomer comprises at least one member selected from the group consisting of natural rubber, isoprene rubber, 1,4-butadiene rubber, 1,2-butadiene rubber, styrene-butadiene copolymer rubber, chloroprene rubber, nitrile rubber, butyl rubber, ethylene-propylene copolymer rubber, ethylene-propylene-butadiene copolymer rubber, ethylene-propylene-ethylidene norbornene copolymer rubber, chlorosulfonated polyethylene elastomer, acrylic rubber, epichlorohydrin rubber, polysulfide rubber, silicone rubber, fluoro rubber, polyurethane elastomer, polyolefin elastomer in which the above-mentioned rubbers or ethylene-vinyl acetate copolymers have been blended with polyethylene, polyamide elastomer, polyester elastomer, polystyrene elastomers selected from the group consisting of styrene-butadiene-styrene-copolymer elastomer, styrene-ethylene-butylene-styrene copolymer elastomer, acrylonitrile-butadiene-styrene copolymer elastomer or hydrogenated products thereof, and plasticized vinyl chloride resin.

3. The papermaking press felt according to claim 1, wherein the polymeric elastomer is dispersedly attached to the fiber in the wet paper web carrying side batt layer by coating and/or impregnating on the wet paper web carrying side surface of the wet paper web carrying side batt layer with the polymeric elastomer.

4. The papermaking press felt according to claim 1, wherein the film has a size of 10 mm width, 120 mm length, and 0.5 mm thickness.

5. The papermaking press felt according to claim 4, wherein the modulus value of the film is obtained by stretching the film to an elongation percentage of 110% at a stretching speed of 200 mm/min, in which the film is set between two grips in a 40 mm grip distance, and taking the stress (kg/cm$^2$) at an elongation percentage of 100% as the 100% modulus value.

6. The papermaking press felt according to claim 5, wherein the residual strain after a 100% elongation is obtained by stretching the film to an elongation percentage of 100%, in which the film is set between two grips in a 40 mm grip distance, reversing the elongation of the film at the same speed the moment after reaching the elongation percentage of 100%, and taking the percentage of elongation when the stress reached 0 kg/cm$^2$ as the residual strain after a 100% elongation.

7. The papermaking press felt according to claim 4, wherein the residual strain after a 100% elongation is obtained by stretching the film to an elongation percentage of 100%, in which the film is set between two grips in a 40 mm grip distance, reversing the elongation of the film at the same speed the moment after reaching the elongation percentage of 100%, and taking the percentage of elongation when the stress reached 0 kg/cm$^2$ as the residual strain after a 100% elongation.

* * * * *